US009010457B2

(12) United States Patent
Kamegai et al.

(10) Patent No.: US 9,010,457 B2
(45) Date of Patent: Apr. 21, 2015

(54) IMPACT TOOL

(75) Inventors: Hikaru Kamegai, Anjo (JP); Takuro Konishi, Anjo (JP)

(73) Assignee: Makita Corporation, Anjo (JP)

( * ) Notice: Subject to any disclaimer, the term of this patent is extended or adjusted under 35 U.S.C. 154(b) by 573 days.

(21) Appl. No.: 13/399,416

(22) Filed: Feb. 17, 2012

(65) Prior Publication Data

US 2012/0234571 A1 Sep. 20, 2012

(30) Foreign Application Priority Data

Mar. 18, 2011 (JP) ..... 2011-061229

(51) Int. Cl.

| | |
|---|---|
| ***B25D 9/08*** | (2006.01) |
| ***B25D 9/14*** | (2006.01) |
| ***B25D 9/00*** | (2006.01) |
| ***B25D 9/04*** | (2006.01) |
| ***B25D 17/06*** | (2006.01) |
| ***B25D 17/20*** | (2006.01) |
| ***B25D 11/00*** | (2006.01) |

(52) U.S. Cl.

CPC ..... *B25D 17/06* (2013.01); *B25D 2211/068* (2013.01); *B25D 2217/0019* (2013.01); *B25D 2250/035* (2013.01); *B25D 2250/131* (2013.01); *B25D 17/20* (2013.01); *B25D 11/005* (2013.01); *B25D 2250/245* (2013.01)

(58) Field of Classification Search

CPC ..... B25D 11/125; B25D 9/08; B25D 9/14; B25D 9/00; B25D 9/04

USPC ..... 173/200–201, 204, 128, 212, 210

See application file for complete search history.

(56) References Cited

U.S. PATENT DOCUMENTS

| | | | | |
|---|---|---|---|---|
| 3,223,181 | A | 12/1965 | Price | |
| 4,732,219 | A * | 3/1988 | Chromy | 173/200 |
| 6,116,352 | A | 9/2000 | Frauhammer et al. | |
| 2002/0185288 | A1 * | 12/2002 | Hanke et al. | 173/201 |

FOREIGN PATENT DOCUMENTS

| | | |
|---|---|---|
| EP | 1 607 187 A1 | 12/2005 |
| JP | A-11-058262 | 3/1999 |

OTHER PUBLICATIONS

Extended European Search Report issued in European Application No. 12156674.9 dated Jul. 20, 2012.

* cited by examiner

*Primary Examiner* — Michelle Lopez
(74) *Attorney, Agent, or Firm* — Oliff PLC

(57) ABSTRACT

A hammer drill includes, in a cylinder accommodated in a housing, a piston configured to advance and retract and an impact element to operate together with the piston with an air chamber interposed therebetween, and a bit mounted in a front part of a tool main body so that an impact operation can be transmitted to the bit by advancing and retracting movement of the impact element. Vent holes are provided in the cylinder, and configured to discharge air in the air chamber to outside of the cylinder, and to introduce the air outside the cylinder into the air chamber by the movement of the piston. One of the vent holes is located at a center of an upper half of a periphery of the cylinder and the other vent hole is located in a lower half of the periphery of the cylinder.

9 Claims, 5 Drawing Sheets

IMPACT TOOL

BACKGROUND OF INVENTION

This application claims the benefit of Japanese Patent Application Number 2011-061229 filed on Mar. 18, 2011, the entirety of which is incorporated by reference.

TECHNICAL FIELD

The present invention relates to impact tools, such as a hammer and a hammer drill, which transmit an impact operation to a bit mounted in a front part of a tool main body by advancing/retracting movement of a piston in a cylinder.

BACKGROUND OF INVENTION

As an example of the conventional impact tools, Japanese Patent Application Publication No. JP H11-58262 A discloses an impact tool that effectively suppresses shock when striking is started from a state in which no-load striking is prevented. In this impact tool, an impact element is accommodated in front of the piston in a cylinder, and the air chamber is interposed between the impact element and the piston. The impact element is movable in the longitudinal direction through an air chamber. Auxiliary holes, front air holes, and rear air holes are provided at the position of the air chamber in the cylinder so as to be shifted in position from each other in the axial direction of the cylinder.

When this conventional impact tool starts striking, these holes are sequentially closed, and the impact tool is gradually switched to a sealed state (a full-load striking state). Thus, the impact element is not rapidly retracted rearward by the piston reciprocating in the cylinder.

Further, in order to implement a proper pressure fluctuation in the air chamber during reciprocation of the piston, this impact tool has a single vent hole near the top of the upper half of the peripheral surface of the cylinder to allow the air chamber to communicate with the outside of the cylinder. While the piston reciprocates, a part of the air in the air chamber is discharged through the vent hole, or the air outside the cylinder is introduced into the air chamber through the vent hole.

However, taking the air into or out of the air chamber through the single vent hole may generate a pressure difference in the air chamber because the pressure in the air chamber decreases partially. The piston and the impact element are subjected to uneven pressures due to the pressure difference. If the piston and the impact element are tilted by such different pressures, and reciprocate while being pressed against the inner surface of the cylinder, heat may be generated by the friction of the piston and the impact element with the cylinder.

Such friction of the piston and the impact element with the cylinder may reduce the operating speed of the piston and the impact element, thereby reducing operation efficiency of the impact tool.

SUMMARY OF INVENTION

The present invention has been developed in view of the above problems, and it is an object of the present invention to provide an impact tool that suppresses heat generation during operation of the impact tool and that suppresses reduction in operation efficiency.

A first aspect of the present invention is an impact tool including a housing, a cylinder accommodated in the housing, a piston configured to advance and retract in the housing, an impact element configured to operate together with the piston with an air chamber interposed therebetween in the housing, a bit mounted in a front part of a tool main body, and configured so that an impact operation can be transmitted to the bit by advancing/retracting movement of the impact element, and a vent hole provided in the cylinder, and configured to discharge air in the air chamber to outside of the cylinder by the advancing movement of the piston, and to introduce the air outside the cylinder into the air chamber by the retracting movement of the piston. In the impact tool, a plurality of the vent holes are formed along a circumferential direction of the cylinder, and at least two of the vent holes are arranged so that one of the vent holes is located at a center of one half of a periphery of the cylinder and the other vent hole is located in the other half of the periphery of the cylinder.

According to a second aspect of the present invention, in the first aspect, the plurality of the vent holes are two vent holes provided to face each other on a circumference of the cylinder.

According to a third aspect of the present invention, in the first aspect, the plurality of the vent holes are three or more vent holes provided at regular intervals on a circumference of the cylinder.

According to a fourth aspect of the present invention, in the first aspect, an air introducing port, which is configured to allow the air to flow in the housing, is provided at a position in front of a rear end of the cylinder in the housing.

According to the impact tool of the first aspect of the present invention, the air chamber communicates with the outside of the cylinder via the plurality of vent holes provided in the one half and the other half of the periphery of the cylinder. This can suppress generation of the pressure difference in the air chamber. Thus, a uniform pressure is applied to the piston and the impact element, and the piston and the impact element can advance and retract without being tilted in the cylinder. This can suppress heat generation due to friction of the piston and the impact element with the cylinder.

Moreover, since the piston and the impact element advance and retract without being tilted in the cylinder, an increase in friction resistance of the piston and the impact element with the cylinder can be suppressed. Thus, a decrease in operating speed of the piston and the impact element can be suppressed, and a decrease in operation efficiency can be expected to be suppressed.

According to the second aspect of the present invention, the plurality of vent holes formed along the circumferential direction of the cylinder are two vent holes facing each other on the circumference of the cylinder. Thus, it is possible to suppress generation of the pressure difference in the air chamber by the minimum required number of vent holes.

According to the third aspect of the present invention, since the air can be uniformly introduced into or discharged from the air chamber through the three or more vent holes provided at regular intervals on the circumference of the cylinder, a uniform air pressure can be maintained in the air chamber.

According to the fourth aspect of the present invention, if it is desired to enhance the effect of cooling the cylinder accommodating the piston and the impact element during the operation of the impact tool, the cylinder can be cooled by the air introduced into the housing through the air introducing port. This can further suppress an increase in temperature during operation of the impact tool.

DETAILED DESCRIPTION OF PREFERRED EMBODIMENTS

Figure 1:
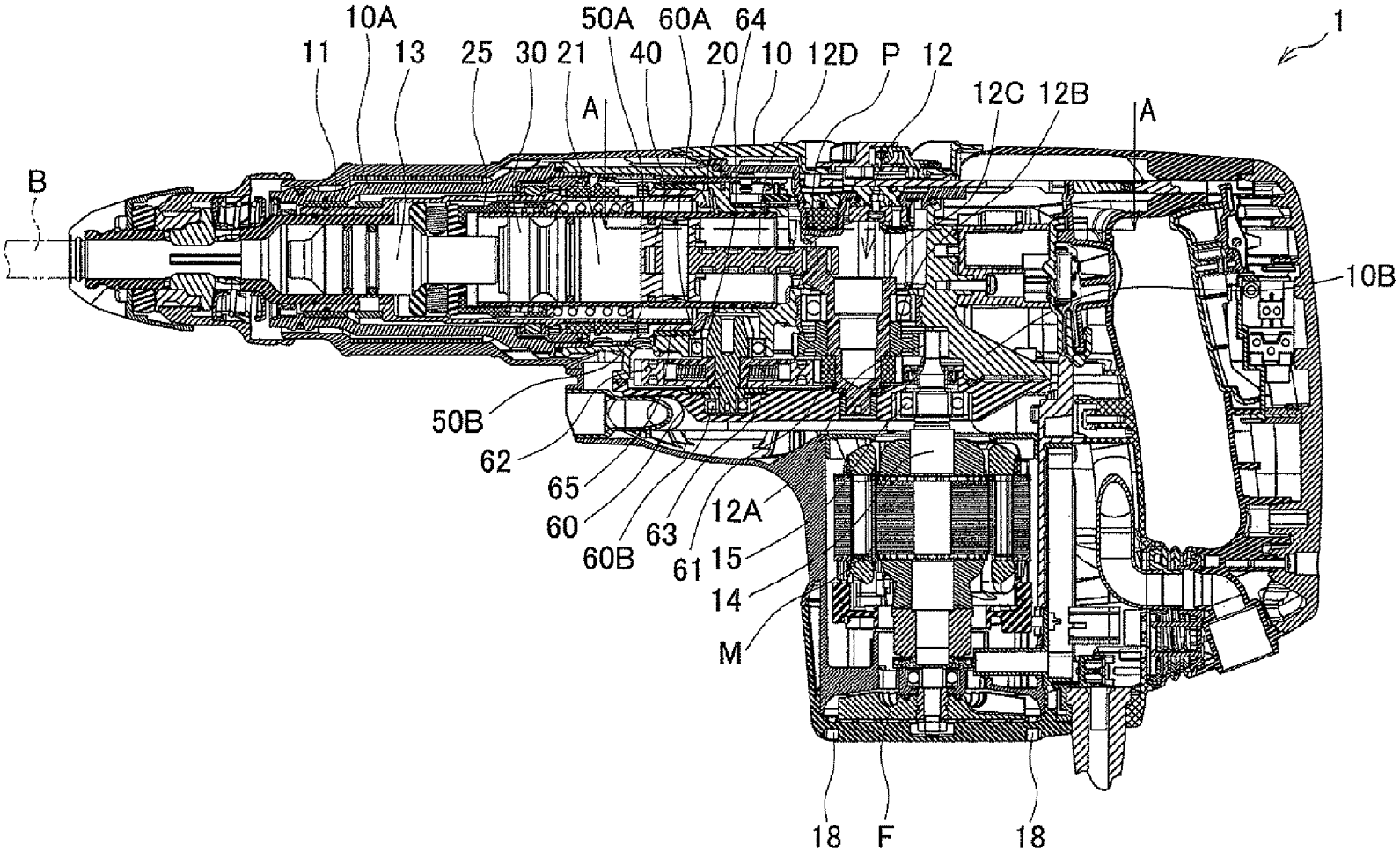
FIG. 1 is a side cross-sectional view of a hammer drill according to an embodiment of the present invention.
Figure 2:
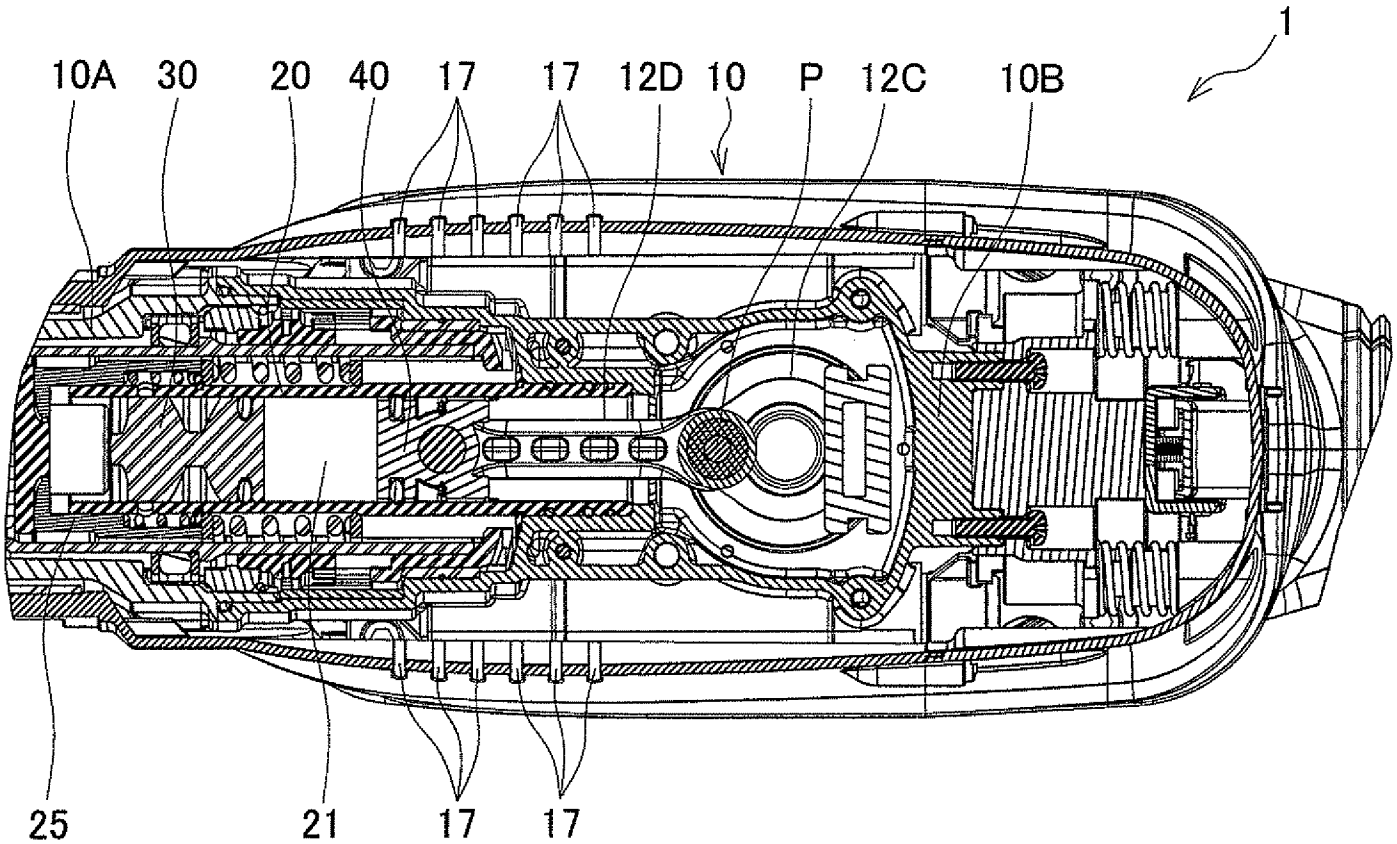
FIG. 2 is a cross-sectional view taken along line A-A in FIG. 1.

An embodiment of the present invention will be described below with reference to FIGS. 1 to 5. As shown in FIGS. 1 and 2, a hammer drill 1 includes a main body housing 10, a cylinder 20, a striker 30, a piston 40, and vent holes 50A, 50B. The hammer drill 1 is an example of an impact tool of the present invention.

The main body housing 10 is made of a resin, and a rotation-impact unit 12 having a tool holder 11 protruding forward (leftward in FIG. 1) is accommodated in an upper part of the main body housing 10. A bit B can be inserted and mounted in a tip end of the tool holder 11. The tool holder 11 accommodates an impact bolt 13 behind the bit B so that the impact bolt 13 can advance and retract at a predetermined stroke. The tool holder 11 is supported by a holder housing 10A, and a metal crank housing 10B, which covers the rotation-impact unit 12, is coupled behind the holder housing 10A. Note that the main body housing 10 is an example of a housing of the present invention.

A motor M having an output shaft 14 extending in the vertical direction is accommodated in a rear lower part of the main body housing 10. The output shaft 14 is supported by a ball bearing 15, and is inserted in the rotation-impact unit 12. A cooling fan F of the motor M is fitted on a lower end of the output shaft 14.

The rotation-impact unit 12 includes a drive gear 12A, a driven gear 12B, a crankshaft 12C, and a connecting rod 12D. The drive gear 12A is rotatably provided on the output shaft 14, and meshes with the driven gear 12B. The crankshaft 12C rotates integrally with the driven gear 12B, and an eccentric pin P is provided on an upper surface of the crankshaft 12C at a position that is displaced from the rotation center by a predetermined distance. The eccentric pin P protrudes from the upper surface of the crankshaft 12C. A rear end of the connecting rod 12D is coupled to the eccentric pin P, and a front end of the connecting rod 12D is coupled to the piston 40. The crankshaft 12C and the connecting rod 12D convert rotation of the output shaft 14 to reciprocating movement of the piston 40.

As shown in FIG. 1, a decelerating shaft 60 is supported in the main body housing 10 at a position below the tool holder 11 and in front of the output shaft 14 so as to extend parallel to the output shaft 14. An upper end of the decelerating shaft 60 is supported by a ball bearing 60A, and a lower end of the decelerating shaft 60 is supported by a ball bearing 60B. Rotation is transmitted from the drive gear 12A to the decelerating shaft 60 by a first transmission gear 61 coupled to the crankshaft 12C, a second transmission gear 62 meshing with the first transmission gear 61, and an overload protection clutch 63. A first bevel gear 64 provided on the upper end of the decelerating shaft 60 meshes with a second bevel gear 65 capable of rotating together with the tool holder 11.

Figure 3:
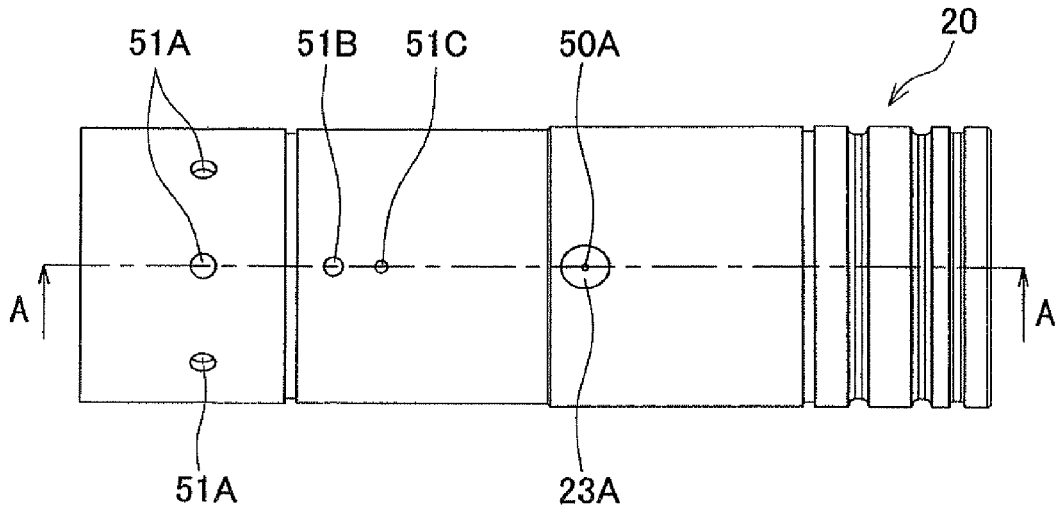
FIG. 3 is a plan view of a cylinder included in the hammer drill.
Figure 4:
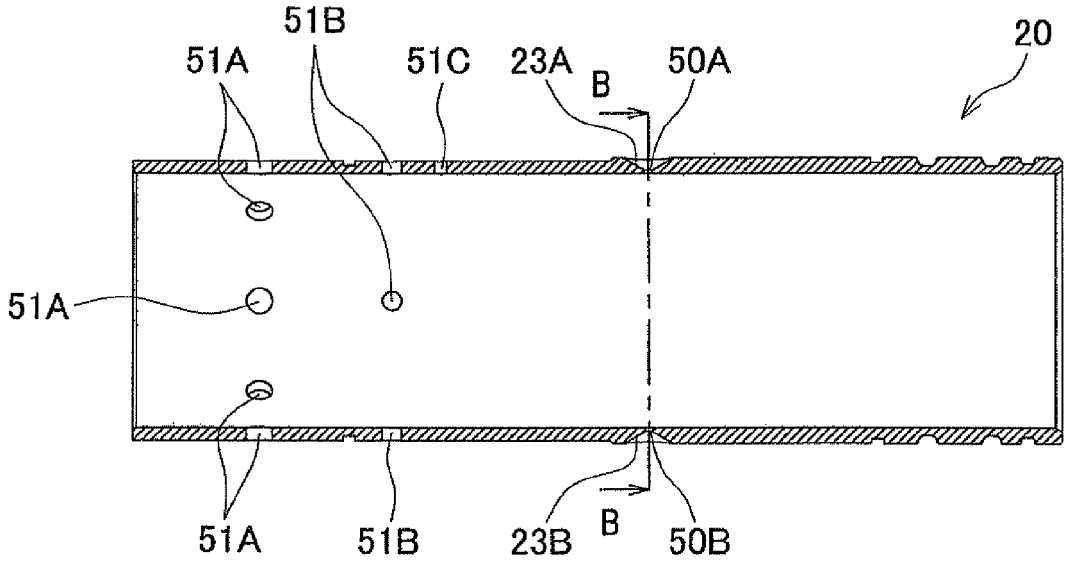
FIG. 4 is a cross-sectional view taken along line A-A in FIG. 3.
Figure 5:
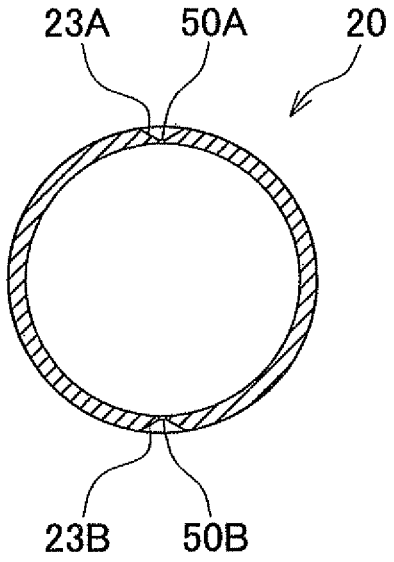
FIG. 5 is a cross-sectional view taken along line B-B in FIG. 4.

The cylinder 20 is accommodated in the crank housing 10B so as to be coaxial with the tool holder 11. The striker 30 and the piston 40 are accommodated in the cylinder 20 so as to be able to advance and retract in the cylinder 20. The striker 30 is accommodated in a front part of the cylinder 20, and the piston 40 is accommodated behind the striker 30 with an air chamber 21 interposed therebetween. As shown in FIGS. 3 to 5, bowl-shaped recesses 23A and 23B, each curving inwards toward its center, are formed in the cylinder 20, and the vent holes 50A and 50B are formed in the recesses 23A and 23B, respectively.

The two vent holes 50A and 50B are configured to allow the air chamber 21 to communicate with the outside of the cylinder 20 in order to adjust the air pressure in the air chamber 21. As shown in FIGS. 1, 4, and 5, the vent holes 50A and 50B are formed at regular intervals on the same circumference of the cylinder 20. As shown in FIG. 5, the vent hole 50A is located at the center of the peripheral surface of the upper half of the cylinder 20, and the vent hole 50B is located at the center of the peripheral surface of the lower half of the cylinder 20. Thus, the vent holes 50A and 50B are arranged so as to face each other on the same circumference of the cylinder 20. The vent holes 50A and 50B are opened when the piston 40 is located at a retracted end position, and are closed when the piston 40 is located at an advanced end position. Note that the vent hole 50A is an example of one vent hole of the present invention, and the vent hole 50B is an example of the other vent hole of the present invention. The peripheral surface of the upper half of the cylinder 20 is an example of "one half of a periphery of the cylinder" of the present invention, and the center of the peripheral surface of the lower half of the cylinder 20 is an example of a location "in the other half of the periphery of the cylinder" of the present invention.

As shown in FIGS. 3 and 4, air holes 51A to 51C for preventing no-load striking are formed in the cylinder 20 at positions in front of the vent holes 50A and 50B. As shown in FIG. 1, a slide sleeve 25 is fitted on the front part of the cylinder 20 so as to be able to advance and retract. The slide sleeve 25 is biased to an advanced position by a coil spring. The slide sleeve 25 moves to a retracted position when the bit B is pressed against a workpiece.

As shown in FIG. 2, a plurality of air inlets 17 are formed in the left and right side surfaces of the upper part of the main body housing 10 at positions in front of a rear end (on the right side in FIG. 2) of the cylinder 20. Each air inlet 17 is used to introduce air outside the main body housing 10 into the main body housing 10. As shown in FIG. 1, a plurality of air outlets 18 are formed in a peripheral edge in the rear lower part of the main body housing 10. Each air outlet 18 is used to discharge the air introduced into the main body housing 10 to the outside of the main body housing 10. Each air inlet 17 is an example of an air introducing port of the present invention.

Operation of the hammer drill 1 will be described below. When the bit B mounted on the tool holder 11 is pressed against the workpiece, the impact bolt 13 pressed by the bit B moves the slide sleeve 25 to the retracted position. In this state, a switch lever (not shown) provided in the main body housing 10 is operated to drive the motor M, whereby rotation of the output shaft 14 is transmitted to the crankshaft 12C via the drive gear 12A and the driven gear 12B, and rotation of the crankshaft 12C is converted to reciprocating movement of the piston 40 via the connecting rod 12D. With the air holes 51A to 51C closed, the air chamber 21 performs a spring function, and the striker 30 operates according to the reciprocating movement of the piston 40, thereby striking the rear end of the impact bolt 13. Thus, striking of the striker 30 is transmitted to the bit B. Note that the striker 30 is an example of an impact element of the present invention.

On the other hand, the rotation of the output shaft 14 is transmitted to the decelerating shaft 60 via the gears 12A and 12B, the transmission gears 61 and 62, and the clutch 63. The decelerating shaft 60 rotates together with the second transmission gear 62, and the rotation of the decelerating shaft 60 is transmitted to the tool holder 11 via the bevel gears 64 and 65, whereby the tool holder 11 is rotated. Accordingly, the bit B not only performs an impact operation but also rotates.

When the striker 30 and the piston 40 reciprocate, heat is generated by the sliding friction between the striker 30 and the inner surface of the cylinder 20 and the sliding friction between the piston 40 and the inner surface of the cylinder 20, and the air pressure in the air chamber 21 increases accordingly. When both vent holes 50A and 50B are opened in the course of the advancing movement of the piston 40, the peripheral surface of the upper half of the cylinder 20 allows the air chamber 21 to communicate with the outside of the cylinder 20 via the vent hole 50A, and the peripheral surface of the lower half of the cylinder 20 allows the air chamber 21 to communicate with the outside of the cylinder 20 via the vent hole 50B. Thus, the air in the air chamber 21 is discharged from the peripheral surface of the upper half of the cylinder 20 and the peripheral surface of the lower half of the cylinder 20 through the vent holes 50A and 50B respectively to the outside of the cylinder 20. This can prevent the air pressure from decreasing e.g., only in one of the upper and lower regions in the air chamber 21, and can suppress generation of the pressure difference in the air chamber 21. Accordingly, a uniform pressure is applied to the piston 40 and the striker 30, whereby the piston 40 and the striker 30 can be reciprocated without being tilted in the cylinder 20.

On the other hand, when both vent holes 50A and 50B are opened in the course of the retracting movement of the piston 40, the air chamber 21 communicates with the outside of the cylinder 20 via the vent holes 50A and 50B. As a result, the air outside the cylinder 20 is introduced into the air chamber 21 from the peripheral surfaces of the upper and lower halves of the cylinder 20 via the vent holes 50A and 50B. This can prevent the air pressure from changing only in one of the upper and lower regions in the air chamber 21, and can suppress generation of the pressure difference in the air chamber 21.

The heat generated when the striker 30 and the piston 40 reciprocate is conducted to the crank housing 10B via the air discharged to the outside of the cylinder 20 through the vent holes 50A and 50B. Since the crank housing 10B is made of a metal having high thermal conductivity, the heat is rapidly conducted to the entire crankshaft 10B, and is easily dissipated to the outside. Moreover, the air discharged from the peripheral surface of the upper half of the cylinder 20 to the outside of the cylinder 20 via the vent hole 50A and the air discharged from the peripheral surface of the lower half of the cylinder 20 to the outside of the cylinder 20 via the vent hole 50B collide in the crank housing 10B, and this air flow allows the heat to be uniformly conducted to the crank housing 10B. This facilitates dissipation of the heat to the outside of the crank housing 10B.

In the present embodiment, as the cooling fan F rotates with rotation of the output shaft 14, the air outside the main body housing 10 is introduced into the main body housing 10 via the air inlets 17. The air introduced into the main body housing 10 flows directly onto the crank housing 10B from the left and right sides thereof, and thus can cool the crank housing 10B and the cylinder 20 accommodated therein. After flowing onto the crank housing 10B, the air flows down between the crank housing 10B and the main body housing 10, and is guided to the motor M. After flowing through the motor M, the air flows between blades of the cooling fan F, and is discharged to the outside of the main body housing 10 through the air outlets 18.

Effects of the Present Embodiment

In the hammer drill 1 of the present embodiment, the air chamber 21 communicates with the outside of the cylinder 20 via the vent hole 50A provided in the peripheral surface of the upper half of the cylinder 20 and the vent hole 50B provided in the peripheral surface of the lower half of the cylinder 20. This allows the air to be introduced into and discharged from the air chamber 21 through the peripheral surfaces of the upper and lower halves of the cylinder 20, which can suppress the pressure difference in the air chamber 21. Thus, a uniform pressure is applied to the piston 40 and the striker 30, and the piston 40 and the striker 30 can be reciprocated without being tilted in the cylinder 20. This can suppress heat generation due to the sliding friction between the piston 40 and the cylinder 20 and between the striker 30 and the cylinder 20, and can suppress an increase in friction resistance of the piston 40 and the striker 30 with the cylinder 20. Thus, a decrease in operating speed of the piston 40 and the striker 30 can be suppressed, and a decrease in efficiency of processing of the workpiece by the hammer drill 1 can be expected to be suppressed.

Since the two vent holes 50A and 50B are arranged to face each other on the same circumference of the cylinder 20, it is possible to suppress generation of the pressure difference in the air chamber 21 by the minimum required number of vent holes 50A and 50B.

Moreover, during operation of the hammer drill 1, the crank housing 10B accommodating the cylinder 20 can be cooled by the air introduced into the main body housing 10 through the air inlets 17. This can enhance the effect of cooling the cylinder 20 accommodating the piston 40 and the striker 30, and can further suppress an increase in temperature during operation of the hammer drill 1.

The present invention is not limited to the above embodiment, and various modifications and variations can be made to part of the construction as appropriate without departing from the sprit and scope of the invention. Although the two vent holes 50A and 50B are arranged to face each other on the same circumference of the cylinder 20 in the above embodiment, the present invention is not limited to this. One of the vent holes on the same circumference may be provided in a manner similar to that of the vent hole 50A, and the other vent hole may be provided in the peripheral surface of the lower half of the cylinder 20 at a position other than the center of this peripheral surface.

The two vent holes 50A and 50B need not necessarily be provided on the same circumference of the cylinder 20. One of the vent holes may be provided at the center of the peripheral surface of the upper half of the cylinder 20, and the other vent hole may be provided in the peripheral surface of the lower half of the cylinder 20 at a position shifted from the one of the vent holes in the axial direction of the cylinder 20, so that the air chamber 21 can communicate with the outside of the cylinder 20 via both vent holes. Unlike the above embodiment, one of the vent holes on the same circumference may be provided at the center of the peripheral surface of the left half of the cylinder 20, and the other vent hole may be provided in the peripheral surface of the right half of the cylinder 20. Alternatively, one of the vent holes on the same circumference may be provided at the center of the peripheral surface of the right half of the cylinder 20, and the other vent hole may be provided in the peripheral surface of the left half of the cylinder 20.

Moreover, unlike the above embodiment, a plurality of vent holes may be provided at regular intervals on the same circumference of the cylinder 20. For example, four vent holes may be provided at regular intervals on the same circumference of the cylinder 20. This allows the air to be uniformly introduced into or discharged from the air chamber 21 through the plurality of vent holes, whereby a uniform air pressure can be maintained in the air chamber 21.

Furthermore, the plurality of vent holes may be provided at regular intervals on the circumference of the cylinder 20 at positions shifted from each other in the axial direction of the cylinder 20, so that the air chamber 21 can communicate with the outside of the cylinder 20 via the plurality of vent holes. Although the above embodiment is described with respect to an example in which the present invention is applied to the hammer drill 1, the present invention may be applied to a hammer.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool, comprising:

a housing;

a cylinder accommodated in the housing;

a piston configured to advance and retract in the cylinder;

an impact element configured to operate together with the piston with an air chamber interposed therebetween in the cylinder;

a bit mounted in a front part of a tool main body, and configured so that an impact operation can be transmitted to the bit by advancing and retracting movement of the impact element; and a plurality of vent holes provided in and formed along a circumferential direction of the cylinder, a first one of the vent holes being located at a center of a first half of a periphery of the cylinder, and a second one of the vent holes being located in a second half of the periphery of the cylinder, the first vent hole and the second vent hole being configured to discharge air in the air chamber to outside of the cylinder by the advancing movement of the piston and to introduce air from outside the cylinder into the air chamber by the retracting movement of the piston.

2. The impact tool according to claim 1, wherein the first vent hole and the second vent hole face each other on a circumference of the cylinder.

3. The impact tool according to claim 2, wherein the first vent hole and the second vent hole are provided on the same circumference, and the first vent hole is located at a center of a peripheral surface of an upper half of the cylinder, and the second vent hole is located at a center of a peripheral surface of a lower half of the cylinder.

4. The impact tool according to claim 1, wherein the plurality of the vent holes includes at least a third vent hole, the plurality of the vent holes being provided at regular intervals on a circumference of the cylinder.

5. The impact tool according to claim 4, wherein the plurality of vent holes are provided on a same circumference of the cylinder.

6. The impact tool according to claim 1, further comprising:

an air introducing port provided at a position in front of a rear end of the cylinder in the housing, the air introducing port being configured to allow air to flow in the housing.

7. The impact tool according to claim 6, further comprising:

an air outlet formed in a lower part of the housing, the air outlet being configured to discharge the air, which has flown in the housing, to outside of the housing.

8. The impact tool according to claim 1, wherein the cylinder is accommodated in a metal crank housing in the housing, and heat generated by sliding friction between the piston and the cylinder during the advancing and retracting movement of the piston is dissipated through the first vent hole and the second vent hole via the air, and is conducted to the crank housing.

9. The impact tool according to claim 1, wherein the peripheral surface of the cylinder includes at least two bowl-shaped recesses, each of the bowl-shaped recesses curving inward toward a center of the cylinder, and the first vent hole and the second vent hole are respectively formed in the two bowl-shaped recesses.

* * * * *